United States Patent [19]

Thayer

[11] 4,298,314

[45] Nov. 3, 1981

[54] HERMETIC COMPRESSOR HAVING A VALVE TO DRAIN LIQUID ACCUMULATIONS FROM ITS CYLINDER HEAD

[75] Inventor: Paul G. Thayer, Staunton, Va.

[73] Assignee: Westinghouse Electric Corp., Pittsburgh, Pa.

[21] Appl. No.: 110,977

[22] Filed: Jan. 10, 1980

[51] Int. Cl.[3] ..... F04B 35/04; F04B 49/02

[52] U.S. Cl. ..... 417/299; 417/415; 417/434; 417/902

[58] Field of Search ..... 417/279, 299, 307, 366, 417/372, 415, 434, 902

[56] References Cited

U.S. PATENT DOCUMENTS 2,449,740 9/1948 Felser ..... 417/279
3,066,857 12/1962 McCloy ..... 417/902 X
3,119,550 1/1964 West ..... 417/299 X
4,026,122 5/1977 Kuhn et al. ..... 417/299 X

*Primary Examiner*—Richard E. Gluck
*Attorney, Agent, or Firm*—E. C. Arenz

[57] ABSTRACT

A hermetic compressor having an upper portion 12 and a lower portion 16 is provided with a motor 20 in its upper portion with a vertical crankshaft 22 extending down into the lower portion and driving a plurality of pistons 28, 30 in cylinders 24, 26 arranged radially around the crankshaft, each cylinder having a cylinder head 38 radially outwardly of the discharge valve 36, and at least the lowermost cylinder head 38 being provided with a spring-loaded drain valve 44 which opens upon the differential pressure between the inside of the cylinder head and the suction space in the compressor dropping below a given value during periods of non-operation of the compressor to drain an accumulation of liquids in the cylinder head.

3 Claims, 2 Drawing Figures

HERMETIC COMPRESSOR HAVING A VALVE TO DRAIN LIQUID ACCUMULATIONS FROM ITS CYLINDER HEAD

BACKGROUND OF THE INVENTION

This invention pertains to the general art of hermetic refrigerant compressors and particularly to multi-cylinder compressors of this type which have the cylinders arranged radially about a vertical crankshaft.

In compressors of this type a condition occasionally arises in which oil and/or liquid refrigerant collect in the lowermost cylinder heads during extended shutdowns. The accumulation of the liquid can be the result of any of several different conditions such as excessive oil in the refrigerant system or excessive liquid refrigerant in the oil, for example. A small quantity of liquid in the cylinder head space of the type of compressor with which this invention deals is not particularly detrimental, since it will be blown out through the discharge pipe at the top of the cylinder head. However, if there is a significant quantity of liquid in the cylinder head space it is unable to get out through the discharge pipe quickly enough upon start-up and may cause damage to the cylinder head or gasket or valves or connecting rods or piston rings. The possibility of damage with a liquid accumulation is more likely with larger compressors which use large three-phase motors with significant starting torque. With smaller compressors of the type such as typically use permanent slit capacitor motors, the likelihood of such damage is not as great since there is relatively less starting torque. However the application of the invention to such smaller compressors can also function to promote more rapid equalization of pressures between the high side and the low side so that easier starting is promoted.

It is an aim of this invention to provide a hermetic refrigerant compressor with an arrangement which avoids the problems which arise if liquid collects in any of the cylinder heads.

SUMMARY OF THE INVENTION

In accordance with the invention a hermetic refrigerant compressor is provided which includes a hermetic shell with a motor compartment in the upper portion and a crankcase compartment with an oil sump in the lower portion, the motor in the motor compartment driving a vertically disposed crankshaft which extends down into the lower portion wherein a plurality of cylinders are arranged radially around the lower portion of the crankshaft, with each cylinder having suction valve means and discharge valve means, a cylinder head for each cylinder, the head defining a discharge pressure space radially outwardly of the discharge valve means and in communication with the compression space of its cylinder only through the discharge valve means, and drain valve means in the bottom portion of at least the lowermost of said cylinders, said drain valve means having open and closed positions in response to pressures in said discharge pressure space being below and above, respectively, a predetermined pressure, to drain liquid accumulations from the discharge pressure space to the oil sump during periods of non-operation of the compressor.

DESCRIPTION OF THE PREFERRED EMBODIMENT

Figure 1:
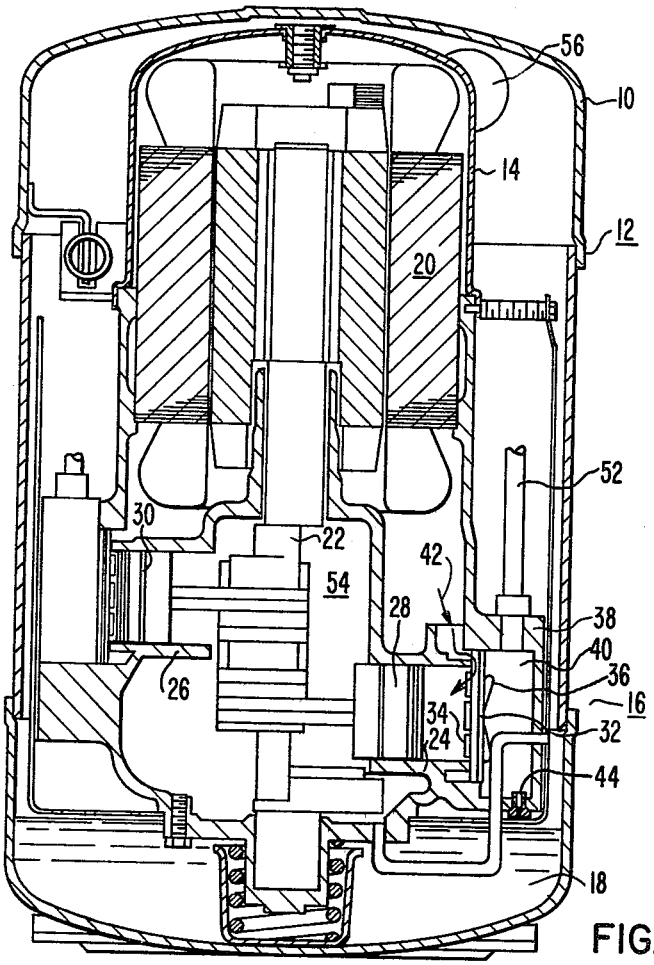
FIG. 1 is a vertical cross-sectional view of a hermetic refrigerant compressor embodying the invention.

Referring to FIG. 1, a hermetic refrigerant compressor of one type embodying the invention is shown by way of example. The compressor has a generally cylindrical, hermetically sealed shell 10 which includes an upper portion 12 with a motor compartment 14 therein, and a lower portion 16 which provides what is herein termed a crankcase compartment with an oil sump 18 in the lower portion.

An electric motor 20 in the motor compartment 14 drives a vertically disposed crankshaft 22 which extends down into the lower portion 16 of the shell. A plurality of cylinders (two of which are shown 24 and 26) are arranged radially around the crankshaft 22, and at different levels so as to permit the connecting rods to be connected to the crankshaft. The compressor shown in FIG. 1 has six cylinders. Of course, each cylinder is provided with a piston which reciprocates within the cylinder, two of the pistons 28 and 30 being shown in FIG. 1. At the radially outer end of each cylinder a valve assembly 32 is provided, each valve assembly including a suction valve portion 34 and a discharge valve portion 36. The particular form of the valve assembly is not important in connection with the invention so no detailed showing of such valve means is made. However, U.S. Pat. No. 3,112,064 shows a valve assembly of the general type suitable for use in the compressor shown, and reference should be had to that patent for details if desired.

Each cylinder is provided with a cylinder head 38 which is of generally cup-shaped form and defines a discharge pressure space 40 radially outwardly of the discharge valve means 36. This discharge pressure space is in communication with the compression space in the cylinder only through the discharge valve means 36 since the valve assembly is of a construction that the path of the suction gases into the cylinder is as shown by the arrow 42 with that path being out of communication with the discharge pressure space.

Figure 2:
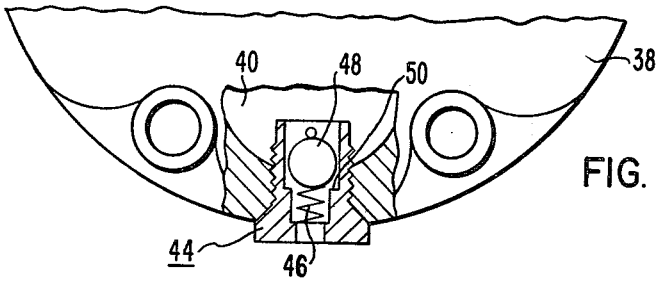
FIG. 2 is a partly broken elevational view of a part of a cylinder head of one of the lower cylinders.

The bottom portion of the cylinder head 38 of at least the lowermost of the cylinders is provided with drain valve means 44 (FIGS. 1 and 2) to permit the drainage of any accumulated liquid in the discharge pressure space of the cylinder head during periods of nonoperation. One form the drain valve 44 may take is as in FIG. 2 in which it is shown as a small, spring-loaded, ball drain valve in which a light coil spring 46 holds the ball 48 off the seat 50 as shown when the pressure differential between the suction and discharge falls below a predetermined value of, say, 35 psi, after the compressor has stopped. This drains any accumulated oil/or liquid refrigerant back to the oil sump so that upon a subsequent start-up liquid slugging and resultant compressor damage is avoided. With the arrangement as shown, when the compressor is restarted the rapid build-up of pressure in the discharge pressure space 40 causes the valve 44 to quickly close and to remain closed until the next shutdown so that normal pumping operation of the compressor is available.

It is noted that the primary function of the valve is as a drain valve for the oil and/or liquid refrigerant which can accumulate in the cylinder head space. The manner in which the oil and any liquid refrigerant can arrive at this space after shutdown is in part by drippage from the inside of the discharge pipe 52 (FIG. 1) along with seepage from the crank chamber 54 which, during compressor operation, is normally at a slightly higher pressure, the seepage being past the piston 28 and by seepage through the discharge valve into the discharge pressure space 40. It is emphasized that the discharge pressure space 40 is at a high pressure during operation and this pressure is trapped in the discharge pressure space when the compressor stops, irrespective of the piston position. Of course, the discharge valve 36 is also closed when the compressor stops which traps this pressure in the discharge pressure space.

A secondary benefit of the drain valve arrangement is that during compressor shutdown there is quicker equalization between the high and low sides of the system. Most of the space in the shell surrounding the motor housing and crankcase is at suction pressure, the inlet for the suction gas being indicated at 56, it being understood that the discharge pressure lines 52 are manifolded (not shown) with the discharge gas exiting from the shell through a single pipe in hermetically sealed relation with the shell. Thus, after the compressor has shut down after normal operation and the differential between the high side and low side drops below the particular setting of the drain valve, the drain valve will open so that then complete equalization will quickly occur.

I claim:

1. A hermetic refrigerant compressor comprising:

a hermetic shell having a motor compartment in its upper portion and a crankcase compartment with an oil sump in its lower portion;

a motor in said motor compartment driving a vertically disposed crankshaft which extends down into said lower portion;

a plurality of cylinders arranged radially around the lower portion of said crankshaft and driven thereby, each cylinder having suction valve means and discharge valve means;

a cylinder head for each cylinder, said head defining a discharge pressure space radially outwardly of said discharge valve means and in communication with the compression space of its cylinder only through said discharge valve means; and drain valve means in the bottom portion of said cylinder head of at least the lowermost of said cylinders, said drain valve means having open and closed positions in response to pressures in said discharge pressure space below and above, respectively, a predetermined pressure, to drain liquid accumulations from said discharge pressure space to said oil sump during period of non-operation of said compressor.

2. A compressor according to claim 1 wherein:

said drain valve comprises a spring-loaded ball valve.

3. A compressor according to claim 2 wherein:

said compressor includes a suction gas inlet in communication with the space within said hermetic shell so that said space is at suction pressure.

* * * * *